US007631471B2

(12) United States Patent
Grunewald et al.

(10) Patent No.: US 7,631,471 B2
(45) Date of Patent: Dec. 15, 2009

(54) METHOD AND APPARATUS FOR MOISTURE COLLECTION AND DIVERSION IN CURTAIN WALLS

(75) Inventors: Fred Grunewald, Terrell, TX (US); James P. Clark, Terrell, TX (US)

(73) Assignee: Oldcastle Glass Engineered Products, Inc., Plano, TX (US)

( * ) Notice: Subject to any disclaimer, the term of this patent is extended or adjusted under 35 U.S.C. 154(b) by 803 days.

(21) Appl. No.: 10/836,081

(22) Filed: Apr. 29, 2004

(65) Prior Publication Data

US 2005/0138875 A1 Jun. 30, 2005

Related U.S. Application Data

(60) Provisional application No. 60/467,610, filed on May 2, 2003.

(51) Int. Cl.
*E04B 1/00* (2006.01)

(52) U.S. Cl. ..... 52/745.05; 52/16; 52/61; 52/235; 52/302.6

(58) Field of Classification Search ..... 52/302.3, 52/302.6, 302.7, 13, 15, 16, 136, 137, 302.1, 52/553, 11, 12, 14, 302.2, 302.4, 302.5, 58, 52/61, 62, 235, 741.1, 745.05, 745.08; 174/39
See application file for complete search history.

(56) References Cited

U.S. PATENT DOCUMENTS

| | | | | |
|---|---|---|---|---|
| 334,160 | A * | 1/1886 | Berger | 52/16 |
| 2,282,631 | A | 5/1942 | Winship | |
| 2,703,002 | A * | 3/1955 | Suskind | 52/302.3 |
| 2,777,405 | A * | 1/1957 | Ager | 52/16 |
| 2,810,173 | A | 10/1957 | Bearden | |
| 2,963,126 | A | 12/1960 | Cudini | |
| 3,147,518 | A | 9/1964 | Horgan | |
| D199,828 | S | 12/1964 | Regan | |
| 3,359,700 | A | 12/1967 | Birum, Jr. | |
| 3,522,684 | A | 8/1970 | Grossman | |
| D223,640 | S | 5/1972 | Kemp | |
| D229,757 | S | 1/1974 | Hansen | |
| 3,787,130 | A | 1/1974 | Hemmings et al. | |
| 3,798,862 | A | 3/1974 | Stoakes | |
| D241,312 | S | 9/1976 | McLintock et al. | |
| 4,006,573 | A | 2/1977 | Biebuyck | |

(Continued)

FOREIGN PATENT DOCUMENTS

| | | |
|---|---|---|
| JP | 03-013644 | 1/1991 |

(Continued)

*Primary Examiner*—Richard E Chilcot, Jr.
*Assistant Examiner*—William V Gilbert
(74) *Attorney, Agent, or Firm*—Winstead PC

(57) ABSTRACT

Disclosed is a moisture collection bridge and method for use in a curtain wall system. In one aspect, the moisture collection bridge is placed at an intersection of a vertical mullion and one or more horizontal members. The moisture collection bridge is formed to collect fluid in a recess and divert the fluid out of the curtain wall system through an outlet. This Abstract is provided to comply with rules requiring an Abstract that allows a searcher or other reader to quickly ascertain subject matter of the technical disclosure. This Abstract is submitted with the understanding that it will not be used to interpret or limit the scope or meaning of the claims. 37 CFR 1.72(b).

19 Claims, 6 Drawing Sheets

U.S. PATENT DOCUMENTS 4,050,201 A * 9/1977 Hubbard et al. ..... 52/97
4,055,923 A 11/1977 Biebuyck
4,075,800 A * 2/1978 Molick ..... 52/169.5
4,101,233 A 7/1978 McConnell
D250,189 S 11/1978 Hansen
4,214,405 A 7/1980 Chupik
4,276,729 A 7/1981 Kage et al.
4,307,551 A 12/1981 Crandell
4,307,976 A 12/1981 Butler
4,310,995 A 1/1982 Hanna
4,364,209 A 12/1982 Gebhard
4,370,827 A 2/1983 Furuminato
4,387,542 A 6/1983 Wehr
4,488,378 A 12/1984 Symon
4,519,173 A 5/1985 Roberts
4,545,161 A 10/1985 Baumann
4,573,287 A 3/1986 Hagemeyer
4,611,447 A 9/1986 Krechel
4,614,069 A 9/1986 Tanikawa
4,619,092 A 10/1986 Kaminaga
4,627,201 A 12/1986 Hamamoto
4,633,631 A 1/1987 Crandell
4,638,613 A 1/1987 Tonsmann
4,644,717 A 2/1987 Biebuyck
4,662,136 A 5/1987 Tanikawa
4,662,145 A 5/1987 Tanikawa
4,680,902 A 7/1987 Stefnik
4,685,263 A 8/1987 Ting
D293,885 S 1/1988 Carlmark
4,720,876 A 1/1988 Tomei
4,724,637 A 2/1988 Evans
4,773,193 A 9/1988 Biebuyck
4,783,941 A 11/1988 Loper
4,799,344 A 1/1989 Francis
4,803,820 A 2/1989 Metrick
4,817,351 A 4/1989 Michlovic
4,841,700 A 6/1989 Matthews
4,854,095 A 8/1989 Michlovic
4,866,896 A 9/1989 Shreiner
4,873,806 A 10/1989 Jeschke
4,899,508 A 2/1990 Biebuyck
4,910,931 A * 3/1990 Pardue, Jr. ..... 52/169.5
D310,847 S 9/1990 Dietz
4,956,948 A * 9/1990 Hart ..... 52/16
4,956,954 A 9/1990 Horgan
4,984,400 A 1/1991 Bockmiller
4,996,809 A 3/1991 Beard
5,036,637 A 8/1991 Biebuyck
5,058,344 A 10/1991 Biebuyck
5,065,557 A 11/1991 Laplante
5,077,947 A 1/1992 Takeda
5,185,979 A 2/1993 Azzimonti
5,252,154 A 10/1993 Hoffman
5,253,459 A 10/1993 Parinas
D347,857 S 6/1994 Coe
5,319,882 A 6/1994 Biebuyck
5,333,428 A 8/1994 Taylor
5,354,410 A 10/1994 Cohen
5,369,924 A 12/1994 Neudorf
D363,453 S 10/1995 Herdt
5,469,665 A 11/1995 Biebuyck
5,481,839 A 1/1996 Lang et al.
5,546,713 A 8/1996 Voegele
5,560,149 A 10/1996 Lafevre
5,590,492 A * 1/1997 Cucchiara et al. ..... 52/15
5,592,795 A 1/1997 Rinehart
5,596,851 A 1/1997 Ting
D378,219 S 2/1997 Marshlack
5,644,875 A 7/1997 Nielsen et al.
D393,813 S 4/1998 Herdt
5,746,032 A 5/1998 Koike
5,749,175 A 5/1998 Koike
5,771,652 A 6/1998 Nagata et al.
5,839,236 A 11/1998 Frey
5,875,602 A 3/1999 Lappin et al.
5,893,244 A 4/1999 Magoon
5,930,955 A 8/1999 Biebuyck
5,937,597 A 8/1999 Sono
5,950,370 A 9/1999 Peck
6,158,182 A 12/2000 Biebuyek
6,226,940 B1 5/2001 Biebuyck
6,581,342 B1 6/2003 Tavivian
6,715,248 B2 4/2004 Biebuyck
6,745,527 B1 6/2004 Sherman et al.
6,804,920 B2 10/2004 Hogan
6,993,873 B2 2/2006 Biebuyck et al.
7,191,566 B2 * 3/2007 Back et al. ..... 52/95
2002/0152693 A1 * 10/2002 Krogstad ..... 52/58
2004/0163329 A1 * 8/2004 Back et al. ..... 52/94
2005/0000181 A1 1/2005 Grunewald
2005/0138889 A1 6/2005 Biebuyck
2006/0080917 A1 4/2006 Hall et al.
2006/0201084 A1 9/2006 Arias

FOREIGN PATENT DOCUMENTS

JP 06-065977 3/1994
JP 06-158762 6/1994
JP 06-322866 11/1994

* cited by examiner

METHOD AND APPARATUS FOR MOISTURE COLLECTION AND DIVERSION IN CURTAIN WALLS

CROSS-REFERENCE TO RELATED APPLICATIONS

This patent application claims the benefit of and priority to U.S. Provisional patent application No. 60/467,610 filed May 2, 2003.

BACKGROUND OF THE INVENTION

1. Technical Field

The present invention relates to building curtain walls and, more particularly, but not by way of limitation, to methods of and apparatus for collecting fluids, such as water, infiltrating into the curtain wall system, and diverting said fluid outwardly therefrom.

2. History of the Related Art

The advantages of building curtain wall technology are well known and accepted in the industry. Curtain walls are typically constructed of extruded aluminum frame support members having generally U-shaped channels (although other shapes may apply) for supporting a plurality of panel members that serve as the exterior of a building. Such panel members are most often panes of glass, and often double pane glass sections, but other paneled building materials such as aluminum, granite, slate, or concrete are also utilized. Such panel members are often of identical size and shape. However, near doors, opening windows, or other access points into the building, panel members of different sizes and shapes may be utilized.

Curtain walls generally include a horizontal member intersecting with at least one vertical mullion. Moisture from condensation, precipitation, etc. may collect at this intersection. Typical remedies for removing the fluids that collect in the horizontal channels involve methods and apparatus for channeling the flow of fluid to an exterior portion of the curtain wall system. Such methods and apparatus typically require seals and alignment of sealant and/or parts therefor.

An example of such an approach is the manual sealing around vertical mullions at the intersection of horizontal members. The sealant is ramped at an incline to force the collecting fluid out of the intersection and toward the exit portion along the horizontal member. The quality of the ramping of the sealant is dependent on the skill and care of the laborer. The operation also adds additional cost and time to the project. Furthermore, human error and inconsistency is introduced when requiring a large amount of labor to be performed when ramping the sealant in the curtain wall system.

Another example of such an approach is illustrated in FIG. 1. Horizontal members 10 and vertical mullions 20 intersect, and at this intersection a water deflector 50 may be mounted. The water deflector 50 includes a sloped upper surface 60 for directing fluid to a weep slot 70. Legs 80 hold the water deflector 60 in place. If the water deflector 50 is not placed substantially plumb to the system, then the sloping upper surface 60 may not be effective in directing fluid out of the system.

BRIEF SUMMARY OF THE INVENTION

The present invention generally relates to a method of and apparatus for moisture collection and discharge. The method and apparatus of the present invention comprises, in one embodiment, a moisture collection bridge for diverting fluid from a curtain wall system. The bridge includes a top surface for spanning a specific portion of the curtain wall system, a recess within the top surface for collecting fluid infiltrating therein, and an outlet extending from and in flow communication with the recess, for diverting the fluid to an exterior portion of the curtain wall system.

In another embodiment, the present invention relates to a method of diverting fluid flowing within a curtain wall system to an exterior portion thereof. The method includes forming a top surface of a moisture collection bridge for spanning a specific portion of the curtain wall system, forming a recess of the moisture collection bridge for collecting fluid infiltrating the curtain wall system, forming an outlet of the moisture collection bridge for diverting the fluid to an exterior portion of the curtain wall system, and securing the moisture collection bridge within the curtain wall system in position for the diversion of fluid flowing therein.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE INVENTION

It has been discovered that, when required, the sealing of voids between a vertical mullion and a horizontal member of a curtain wall system can be both time consuming and expensive. Since sealing of the intersection between the vertical mullion and the horizontal member is necessary for some applications in order to prevent uncontrolled water passage, the voids created by the intersection of non-planar members, such as the vertical mullion and the horizontal member of a curtain wall system, present a number of design issues. The moisture collection bridge of embodiments of the present invention provides a method and apparatus for collecting and diverting moisture out of the curtain wall system.

Figure 1:
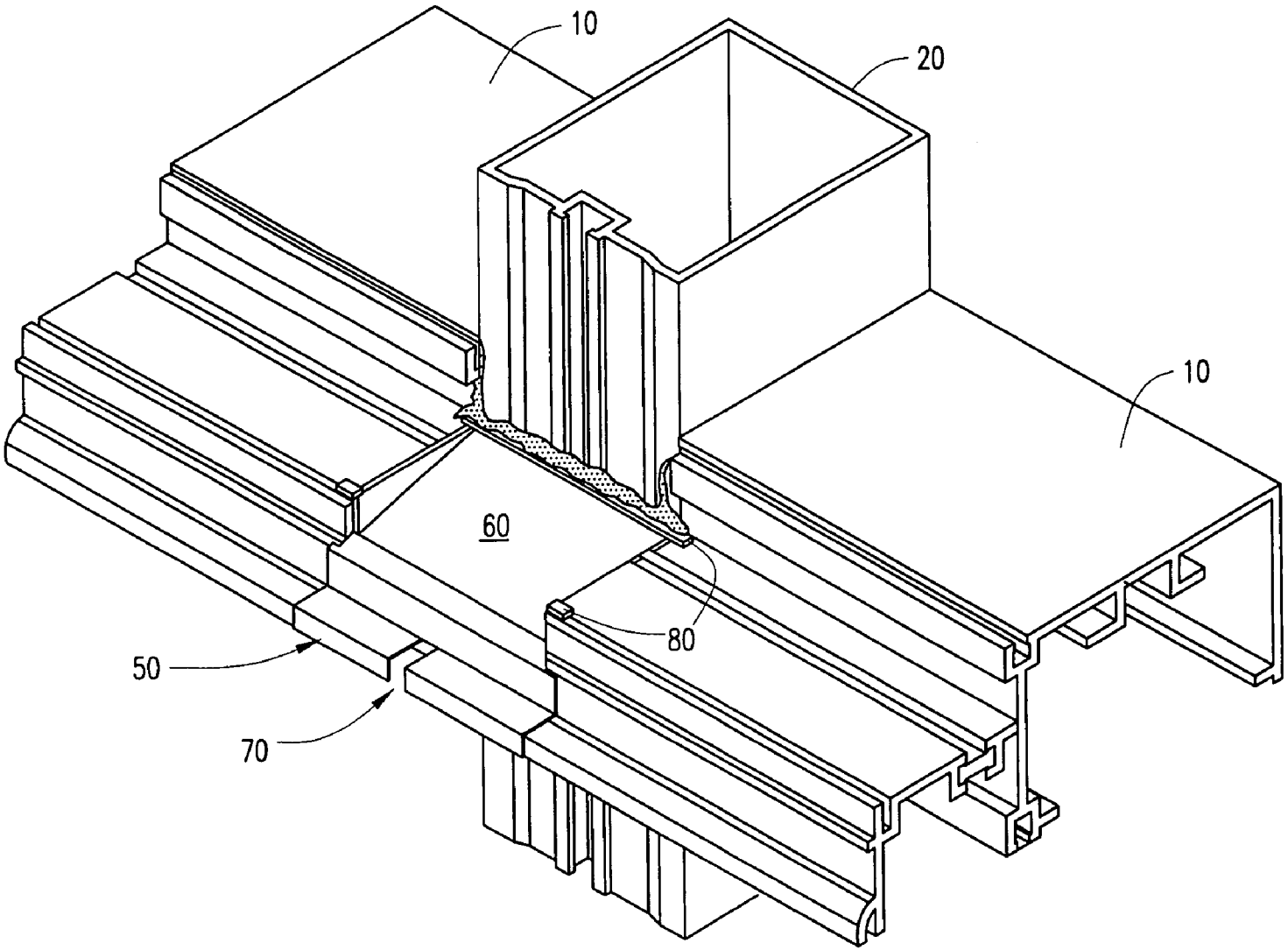
FIG. 1 is a perspective view of a water deflector for a curtain wall system.
Figure 2A:
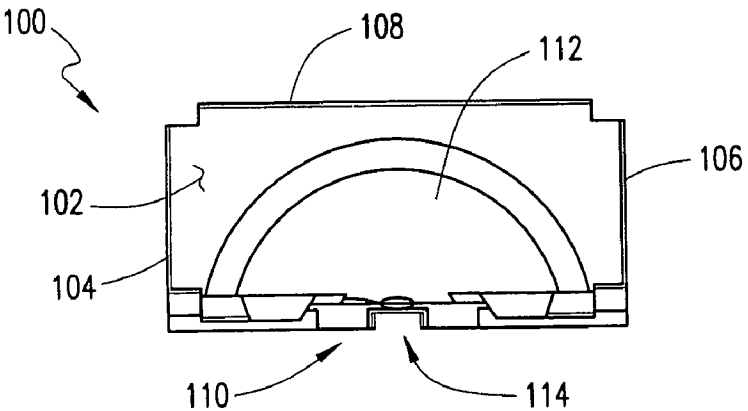
FIG. 2A-2D are various views of a schematic representation of a moisture collection bridge in accordance with an embodiment of the present invention.

Referring to FIGS. 2A-2D, a moisture collection bridge 100 is illustrated, having a generally semi-conical, or generally quasi-infundibular shape. These terms are used herein to generally describe the shape of the moisture collection bridge 100 shown and described. As shown in FIG. 2A, a top view of the moisture collection bridge 100, a top surface 102 is formed, bordered by two side edges 104, 106, a rear face 108, and a front face 110. The two side edges 104, 106 form protrusions on each side of the moisture collection bridge 100. The protrusions (side edges 104, 106) rest on an upper surface of the horizontal members of the curtain wall system (not shown). Formed on the top surface 102 of the moisture collection bridge 100 is a recess 112. Although the recess 112 of the preferred embodiment of the present invention is formed as a funnel with a semi-circular orientation, the recess 112 may also be oriented in a variety of other shapes, such as semi-octagonal, semi-rectangular, etc. The recess 112 leads to an outlet 114 to divert the fluid captured in the recess 112 out of the curtain wall system.

Figure 2B:
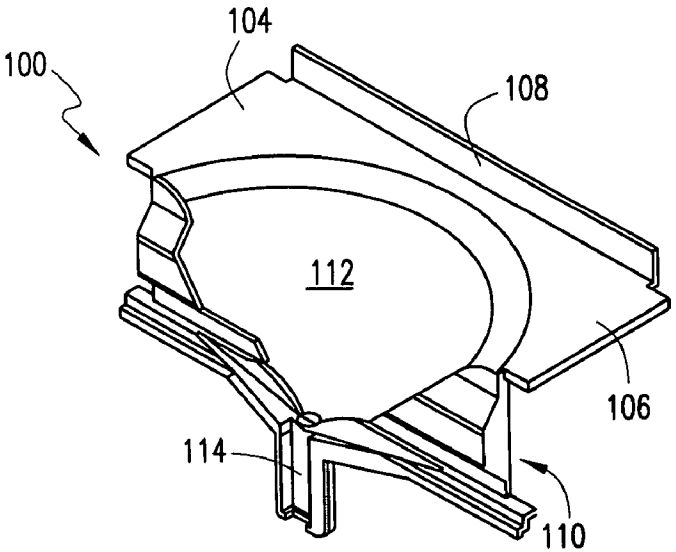

FIG. 2B illustrates a perspective view of the moisture collection bridge 100 of FIG. 2A. Shown more clearly in FIG. 2B, the rear face 108 includes a lip for abutting the vertical mullion (not shown) of the curtain wall system in order to prevent leakage behind the moisture collection bridge 100 and along a top surface of the vertical mullion. Also illustrated more clearly in FIG. 2B, the front face 110 includes a contoured lip for fitting flush against a rear surface of a horizontal cover plate. The contours of the front face 110 may be adjusted to fit a variety of shapes of cover plates or, alternatively, the front face 110 may be planar or have fewer or more contours than those shown in the preferred embodiment. The contour of the front face 110 depends on the type of curtain wall system employed and the type of pressure plate or cover, if any, that is fastened or attached by other means to the horizontal members.

Figure 2C:
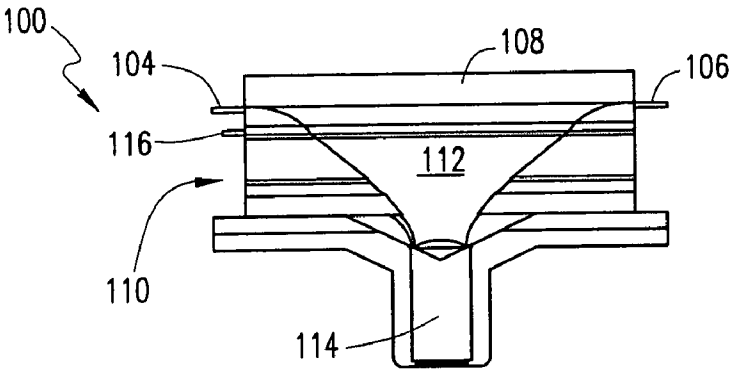
Figure 2D:
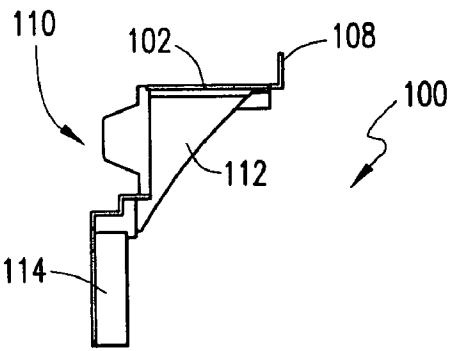

FIG. 2C illustrates a front view of the moisture collection bridge 100 of the present invention. The moisture collection bridge 100 may include a locking mechanism 116 to lock the moisture collection bridge 100 in place in the curtain wall system. By locking the moisture collection bridge 100 in place, less human error may be introduced and therefore failure of the moisture collection bridge 100 may be reduced. As shown in FIG. 2D, a side view of the moisture collection bridge 100, the recess 112 may be oriented at a grade of about 45° from horizontal. The angle of the recess 112 may be adjusted to fit the needs of the curtain wall system.

Figure 3:
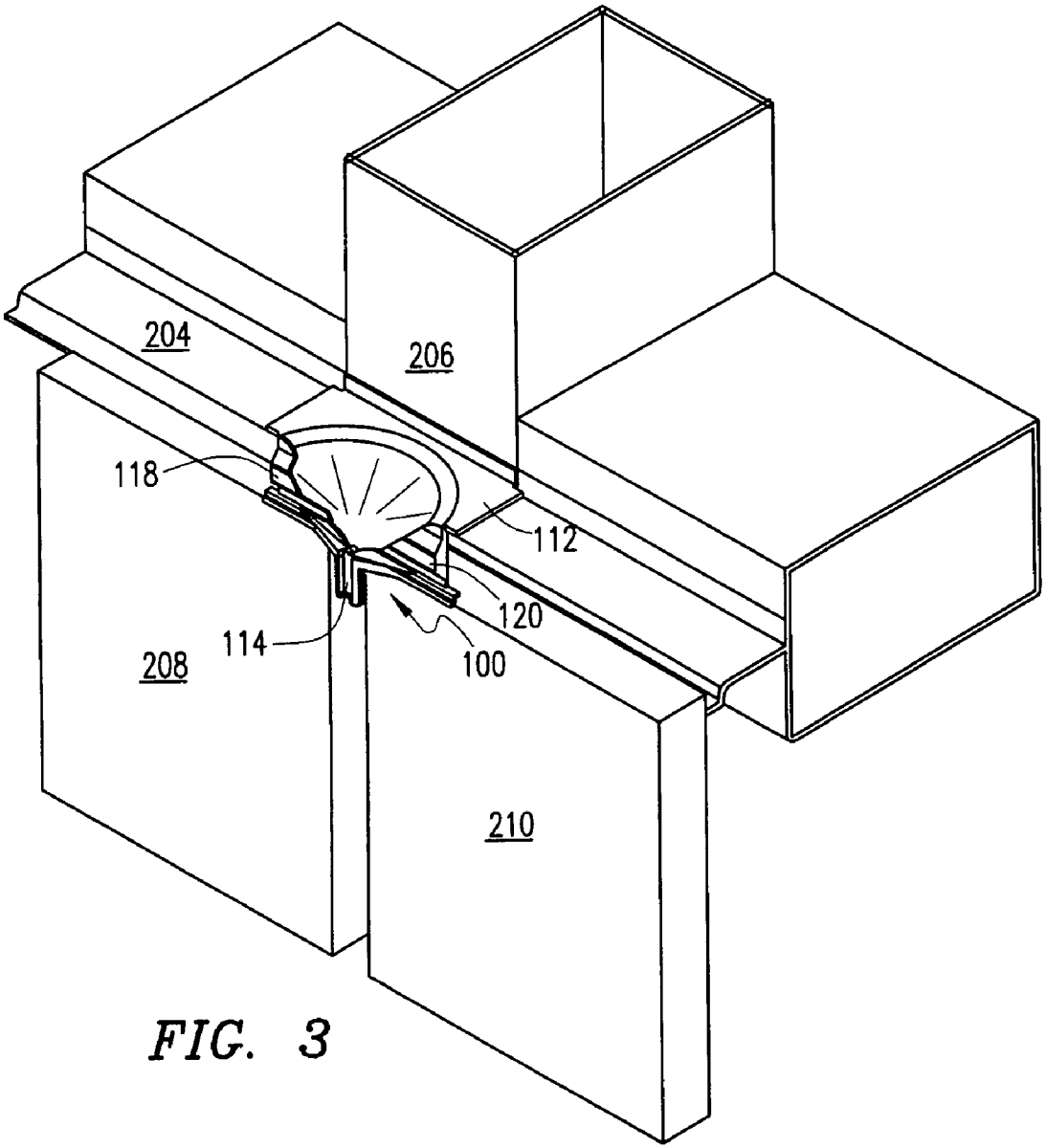
FIG. 3 is a perspective view of the moisture collection bridge of FIGS. 2A-2D installed in a curtain wall system.

Referring now to FIG. 3, the moisture collection bridge 100 is shown placed in a curtain wall system 200. As previously described, the two side edges 104, 106 extend over a portion of the horizontal members 202, 204 of the curtain wall system 200. The rear face 108 abuts the vertical mullion 206 to prevent moisture from leaking behind the moisture collection bridge 100. Sealant may be applied on a top surface and a bottom surface of the side edges 104, 106 and a front surface and a back surface of the rear face 108 to form a water tight seal along the top surface 102 of the moisture collection bridge 100. The outlet 114 extends downward between and in front of two panels 208, 210 that may be formed of glass, marble, or other building material. The fluid is collected at the recess 112 and diverted through the outlet 114 to the exterior of the curtain wall system 200 between and in front of the two panels 208, 210. In this manner, fluid is prevented from collecting in the curtain wall system 200. Protrusions 118, 120 of the front face 110 are formed to abut a portion of the panels 208, 210 and sealed to prevent leakage between the moisture collection bridge 100 and the panels 208, 210.

Figure 4:
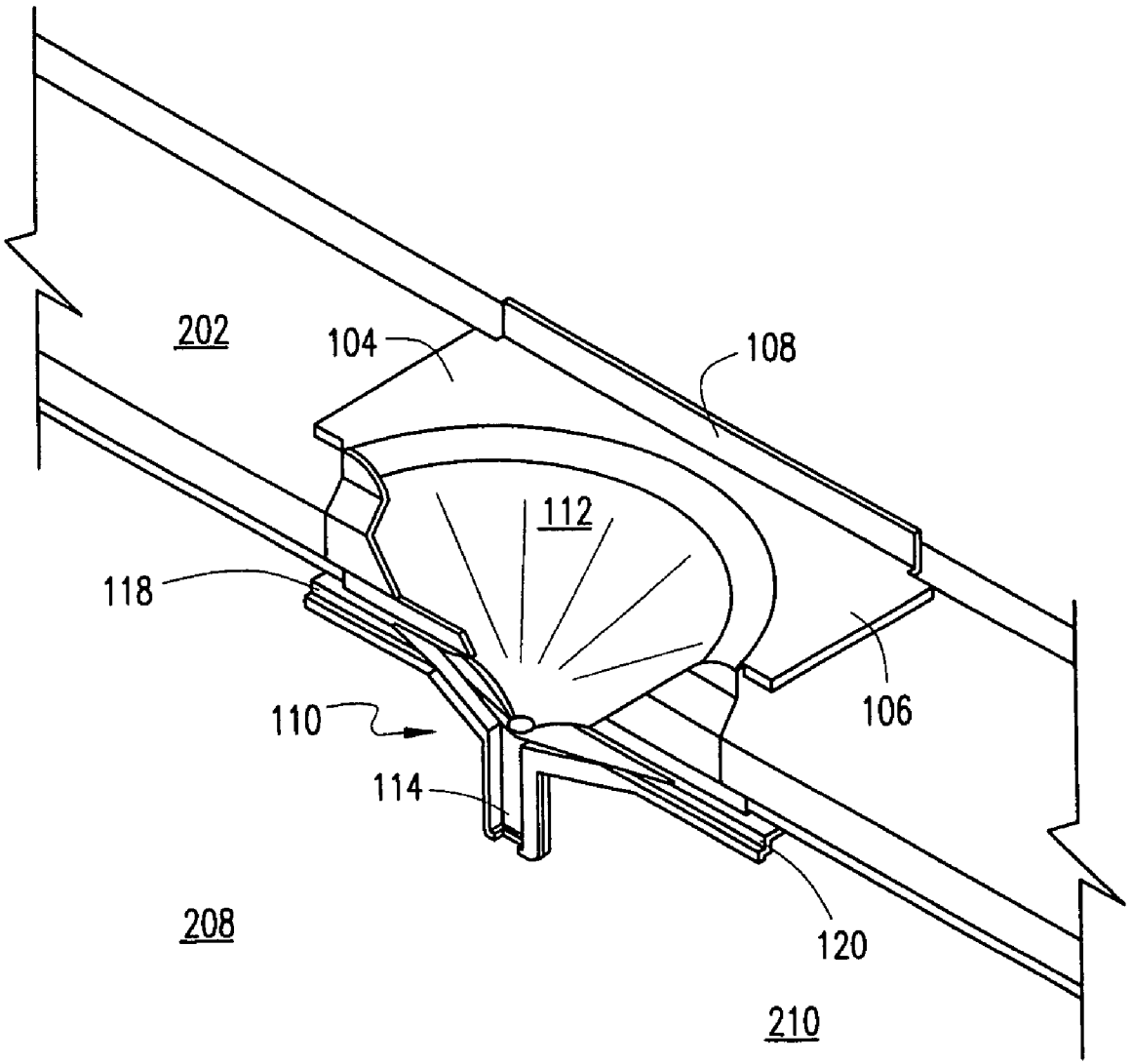
FIG. 4 is an enlarged perspective view illustrated in FIG. 3.

As shown more clearly in FIG. 4, the protrusions 118, 120 of the front face 110 extend along a portion of the panels 208, 210 and are shaped in a stepped manner to facilitate a seal between the horizontal members 202, 204, the panels 208, 210, and the moisture collection bridge 100. Sealant may be applied along all edges, or a portion thereof, to create a water tight seal and prevent leakage to other portions of the curtain wall system 200.

Figure 5:
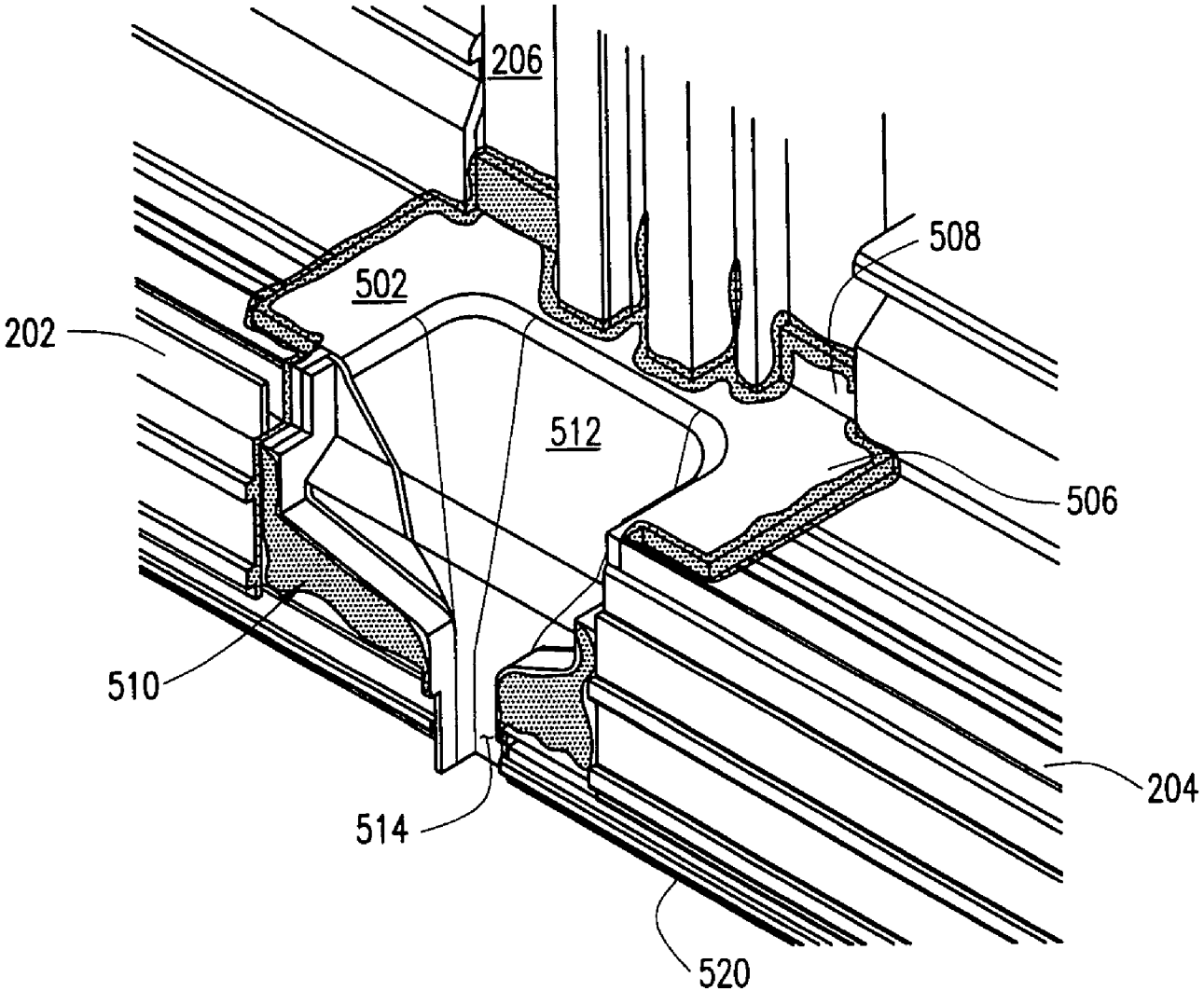
FIG. 5 is a perspective view of a moisture collection bridge in accordance with an alternate embodiment of the present invention.

Referring now to FIG. 5, a moisture collection bridge 500 in accordance with an alternate embodiment of the present invention is illustrated. The moisture collection bridge 500 includes a modified rear face 508 to accommodate various protrusions of the vertical mullion 206. A top surface 502 includes side edges 506 for abutting the horizontal members 202, 204. Instead of contouring a front face 510 of the moisture collection bridge 500 as shown in the previous embodiments, the front face 510 may be substantially planar. Fluid collected by a funnel 512 is directed out of the system by the outlet 514. Side walls of the outlet 514 also act as a stop or termination location for a lower exterior face seal gasket 520.

Figure 6:
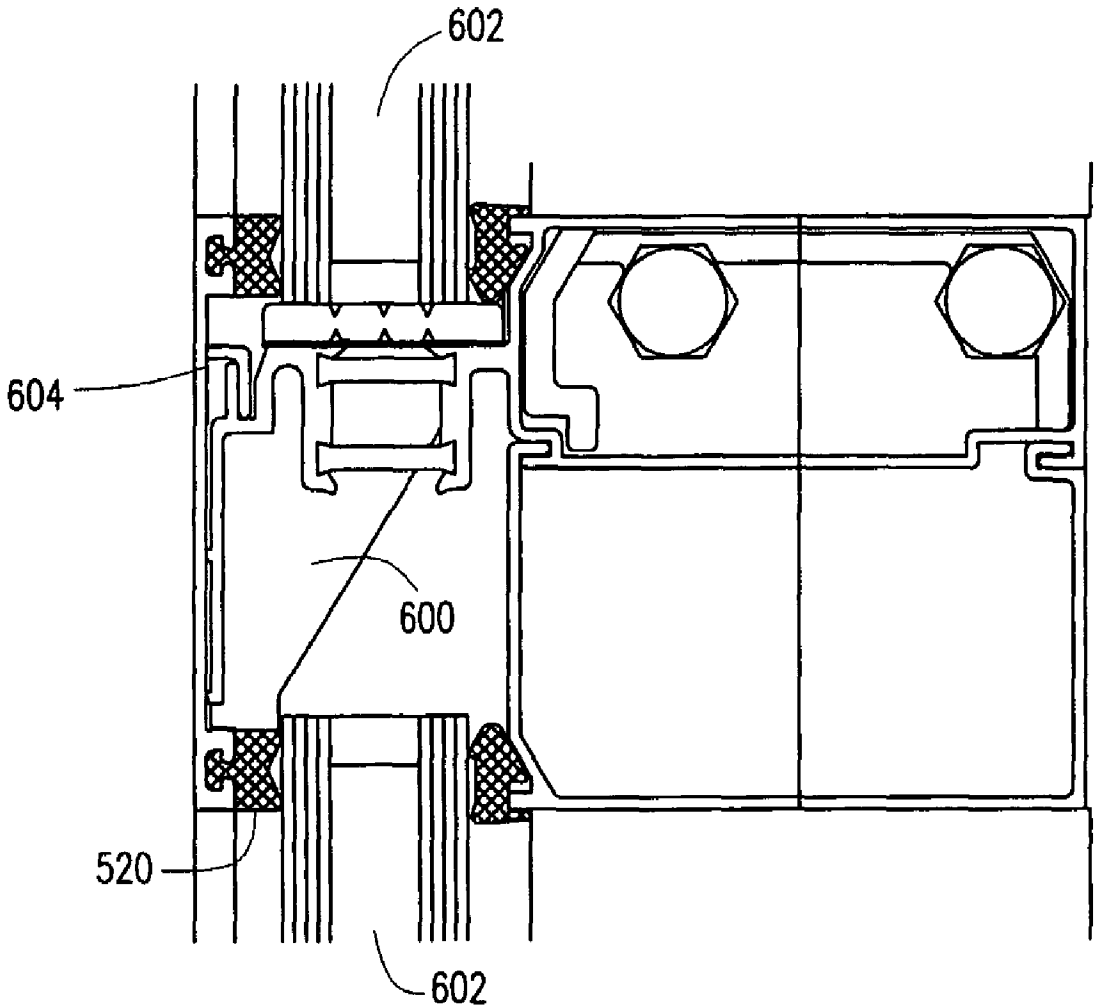
FIG. 6 is a side elevational view of a moisture collection bridge in accordance with an embodiment of the present invention.

Referring now to FIG. 6, a side elevational view of a moisture collection bridge 600 is shown as installed in a curtain wall system. The moisture collection bridge 600 is placed at the intersection of the vertical mullions 602 and horizontal members (not shown). The moisture collection bridge 600 may directly abut at least a portion of a cover plate 604. In addition, side walls of the moisture collection bridge 600 may directly abut at least a portion of the lower exterior seal gasket 520. The side walls prevent the lower exterior seal gasket 520 from blocking the outlet and reducing the effectiveness of the moisture collection bridge 600.

Although the moisture collection bridge 100, 500, 600 is shown as including a funnel-shaped recess 112 and a contoured front face 110, various other geometries and orientations are possible. In addition, the preferred embodiment is utilized at the intersection of the vertical mullion 206 and horizontal members 202, 204. However, other embodiments may be formed in a similar manner to be placed throughout the curtain wall system 200 along the horizontal members 202, 204 or vertical mullions 206 at a variety of positions.

It is thus believed that the operation and construction of the present invention will be apparent from the foregoing description. While the method and apparatus shown or described have been characterized as being preferred it will be obvious that various changes and modifications may be made therein without departing from the spirit and scope of the invention.

What is claimed is:

1. A method of discharging infiltrating fluid from structural components of a building curtain wall having a vertical mullion thereof disposed between generally collinear first and second horizontal structural members, the first and second horizontal structural members being secured to an upper end on opposite sides of the vertical mullion and having ends extending from the vertical mullion defining a void therebetween relative to an outer surface of the vertical mullion, the method comprising: forming a moisture collection bridge having a top surface; forming a recess within the top surface; disposing the moisture collection bridge between the ends of the first and second horizontal structural members within a void located at intersections of the horizontal members and the vertical mullions, wherein the moisture collection bridge abuts the outer surface of the vertical mullion between the ends of the first and second horizontal structural members, the bridge having an upwardly extending flange extending from a rear edge of the bridge, the bridge further having a downwardly extending flange extending from a front edge of the bridge;

collecting fluid infiltrating the curtain wall system in the top surface recess of the moisture collection bridge;

diverting the fluid to an exterior of the building via a channel shaped outlet fluidly coupling the recess and the exterior, wherein the top surface is disposed above a pair of outer wall panels and the outlet extends between the pair of outer wall panels;

and the outlet being located with an open face in plane with the downwardly extending flange.

2. The method of claim 1, further comprising: contouring the front face of the moisture collection bridge to match contours of the horizontal portion of the building curtain wall system.

3. The method of claim 1, further comprising: forming a locking mechanism for locking the moisture collection bridge in place.

4. The method of claim 1, further comprising: orienting the outlet at a substantially 45 degree angle.

5. The method of claim 1, further comprising: placing sealant along at least one side of the top surface.

6. The method of claim 1, further comprising: forming the recess with a generally curvilinear depression.

7. The method of claim 1, further comprising: forming the recess with a generally semi-conical depression.

8. The method of claim 1, further comprising: forming the recess with a generally quasi-infundibular depression.

9. The method of claim 1, further comprising: forming side walls of the moisture collection bridge for preventing a lower gasket from blocking the outlet.

10. A moisture collection bridge for a building curtain wall system having structural components of a building facilitating a discharge of infiltrated fluid between a pair of outer wall panels forming a portion of the curtain wall, the structural components including a vertical mullion and first and second horizontal members secured to an upper end on opposite sides of the vertical mullion and having ends extending outwardly therefrom to define a void between the ends of the first and second horizontal structural members relative to an outer surface of the vertical mullion the moisture collection bridge comprising:

an a top surface spanning the void and mounting to the ends of the first and second horizontal structural members;

a recess formed within the top surface, the recess including an angulated drainage region; and a channel shaped outlet extending from, and in fluid communication with, the angulated drainage region and extending between the pair of outer wall panels; the bridge having an upwardly extending flange extending from a rear edge of the bridge, the bridge further having a downwardly extending flange extending from a front edge of the bridge; and the outlet being located with an open face in plane with the downwardly extending flange.

11. The bridge of claim 10, wherein the front flange is contoured to match contours of the horizontal portion of the building curtain wall system.

12. The bridge of claim 10, further comprising: a locking mechanism for locking the moisture collection bridge in place.

13. The bridge of claim 10, wherein the angulated drainage region is oriented at a substantially 45 degree angle.

14. The bridge of claim 10, wherein sealant is placed along at least one side of the top surface.

15. The bridge of claim 14, wherein the sealant comprises silicone.

16. The bridge of claim 10, wherein the recess is formed as a generally curvilinear depression.

17. The bridge of claim 10, wherein the recess is formed as a generally semi-conical depression.

18. The bridge of claim 10, wherein the recess is formed as a generally quasi-infundibular depression.

19. The bridge of claim 10, wherein the moisture collection bridge further comprises side walls for preventing a lower gasket from blocking the outlet.

* * * * *

UNITED STATES PATENT AND TRADEMARK OFFICE

CERTIFICATE OF CORRECTION

PATENT NO. : 7,631,471 B2
APPLICATION NO. : 10/836081
DATED : December 15, 2009
INVENTOR(S) : Grunewald et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1058 days.

Signed and Sealed this

Twenty-first Day of December, 2010

David J. Kappos

David J. Kappos
*Director of the United States Patent and Trademark Office*